US010798979B2

(12) United States Patent
Hosmer

(10) Patent No.: US 10,798,979 B2
(45) Date of Patent: Oct. 13, 2020

(54) MASK

(71) Applicants: Xiaomi Inc., Haidian District, Beijing (CN); Aetheris (Hong Kong) Limited, Hong Kong (CN)

(72) Inventor: Christopher John Hosmer, Beijing (CN)

(73) Assignees: XIAOMI INC., Beijing (CN); AETHERIS (HONG KONG) LIMITED, Hong Kong (CN)

( * ) Notice: Subject to any disclaimer, the term of this patent is extended or adjusted under 35 U.S.C. 154(b) by 568 days.

(21) Appl. No.: 15/371,234

(22) Filed: Dec. 7, 2016

(65) Prior Publication Data

US 2017/0157436 A1 Jun. 8, 2017

(30) Foreign Application Priority Data

Dec. 7, 2015 (CN) ..... 2015 1 0892228

(51) Int. Cl.

| | |
|---|---|
| ***A41D 13/11*** | (2006.01) |
| ***A62B 23/02*** | (2006.01) |
| ***A62B 18/02*** | (2006.01) |
| ***A62B 18/08*** | (2006.01) |

(52) U.S. Cl.

CPC ..... *A41D 13/1107* (2013.01); *A41D 13/1146* (2013.01); *A41D 13/1161* (2013.01); *A62B 18/025* (2013.01); *A62B 18/084* (2013.01); *A62B 23/025* (2013.01)

(58) Field of Classification Search

CPC ... A62B 18/084; A62B 18/024; A62B 18/008; A62B 18/025; A62B 23/025; A41D 13/11; A41D 13/1161; A61D 13/11–1192; A61M 16/0611

See application file for complete search history.

(56) References Cited

U.S. PATENT DOCUMENTS

| | | | | |
|---|---|---|---|---|
| 4,454,881 A * | 6/1984 | Huber | ..... | A41D 13/1146 128/206.15 |
| 4,947,467 A | 8/1990 | Manoly et al. | | |
| D440,302 S | 4/2001 | Wolfe | | |

(Continued)

FOREIGN PATENT DOCUMENTS

| | | |
|---|---|---|
| CN | 101040731 A | 9/2007 |
| CN | 101317703 A | 12/2008 |

(Continued)

OTHER PUBLICATIONS

English Translation of CN-204763520-U obtained on Oct. 12, 2019. (Year: 2019).*

(Continued)

*Primary Examiner* — Jenna Zhang
(74) *Attorney, Agent, or Firm* — Jun He Law Offices P.C.; James J. Zhu

(57) ABSTRACT

A mask is provided. The mask includes an outer cover made of ultra-fine fibers and formed by hot-pressing, and the outer cover has a plurality of through holes for ventilation; a filter configured to filter air and disposed at a side of the outer cover adjacent to a user; and two sealing pads, each attached to a side of the filter adjacent to the user and configured to contact skins at two sides of a nose bridge of the user to seal gaps between the filter and the two sides of the nose bridge of the user.

18 Claims, 5 Drawing Sheets

(56) References Cited

U.S. PATENT DOCUMENTS

| | | | | |
|---|---|---|---|---|
| 2004/0011362 | A1* | 1/2004 | Angadjivand | A41D 13/1146 128/206.13 |
| 2008/0099022 | A1* | 5/2008 | Gebrewold | A41D 13/1138 128/206.21 |
| 2010/0031962 | A1* | 2/2010 | Chiu | A62B 23/025 128/206.19 |
| 2010/0239625 | A1* | 9/2010 | Puckett | A41D 13/1115 424/402 |
| 2010/0307503 | A1* | 12/2010 | Iwamoto | B32B 5/26 128/205.29 |
| 2011/0156314 | A1 | 6/2011 | Alberg et al. | |
| 2011/0271955 | A1* | 11/2011 | Palomo | A41D 31/12 128/201.17 |
| 2012/0017911 | A1* | 1/2012 | Choi | A62B 18/025 128/206.19 |
| 2012/0097167 | A1* | 4/2012 | Ono | A62B 23/025 128/206.14 |
| 2016/0114197 | A1* | 4/2016 | Fichman | A62B 18/08 128/863 |

FOREIGN PATENT DOCUMENTS

| | | | | |
|---|---|---|---|---|
| CN | 103876357 | A | | 6/2014 |
| CN | 203692605 | U | | 7/2014 |
| CN | 204393418 | U | | 6/2015 |
| CN | 204763520 | U | * | 11/2015 |
| CN | 204763520 | U | | 11/2015 |
| CN | 204812201 | U | | 12/2015 |
| CN | 105795554 | A | | 7/2016 |
| CN | 205624583 | U | | 10/2016 |
| GB | 780710 | A | | 8/1957 |
| GB | 2077112 | A | | 12/1981 |
| KR | 101459300 | B1 | | 11/2014 |
| WO | 9105584 | A1 | | 5/1991 |

OTHER PUBLICATIONS

Partial European Search Report for European Application No. 16202707.2 dated Apr. 25, 2017.

Extended European Search Report for European Application No. 16202707.2 dated Jul. 7, 2017.

International Search Report for PCT Application No. PCT/CN2016/107546 dated Mar. 1, 2017.

Abstract of Foreign Patent documents.

Office Action for Chinese Application No. 201510892228.0(dated Jan. 4, 2018).

* cited by examiner

MASK

CROSS REFERENCE TO RELATED APPLICATIONS

This application is based on and claims priority to Chinese Patent Application No. 201510892228.0, filed on Dec. 7, 2015, the entire contents of which are incorporated herein by reference.

TECHNICAL FIELD

The present disclosure relates to a technical field of hygienic products, and more particularly, to a mask.

BACKGROUND

A design of an ordinary mask is transplanted from a safety mask design. If a fabric for the mask is too soft to form a three-dimensional structure, the mask tends to adhere to a user's face, which hinders respiration of the user. If the fabric for the mask is very stiff, the three-dimensional structure may be formed, but it is uncomfortable for the user to wear the mask and a poor sealing performance is caused. Moreover, when the user wears the mask, the mask will be arched upwards in a center thereof due to a high nose bridge of the user, such that the mask will not be fitted with corresponding regions at two sides of the nose bridge, which results in huge gaps and thus affects both sealing and filtering of the mask. Additionally, the mask has poor air permeability, thus resulting in poor breathing of the user.

SUMMARY

The mask according to embodiments of the present disclosure includes: an outer cover made of ultra-fine fibers and formed by hot-pressing, and the outer cover has a plurality of through holes for ventilation; a filter configured to filter air and disposed at a side of the outer cover adjacent to a user; and two sealing pads, each attached to a side of the filter adjacent to the user and configured to contact skins at two sides of a nose bridge of the user to seal gaps between the filter and the two sides of the nose bridge of the user.

Additional aspects of embodiments of the present disclosure will be given in part in the following descriptions, become apparent in part from the following descriptions, or be learned from the practice of the embodiments of the present disclosure.

It is to be understood that both the foregoing general description and the following detailed description are exemplary and explanatory only and are not restrictive of the disclosure.

REFERENCE NUMERALS

Figure 1:
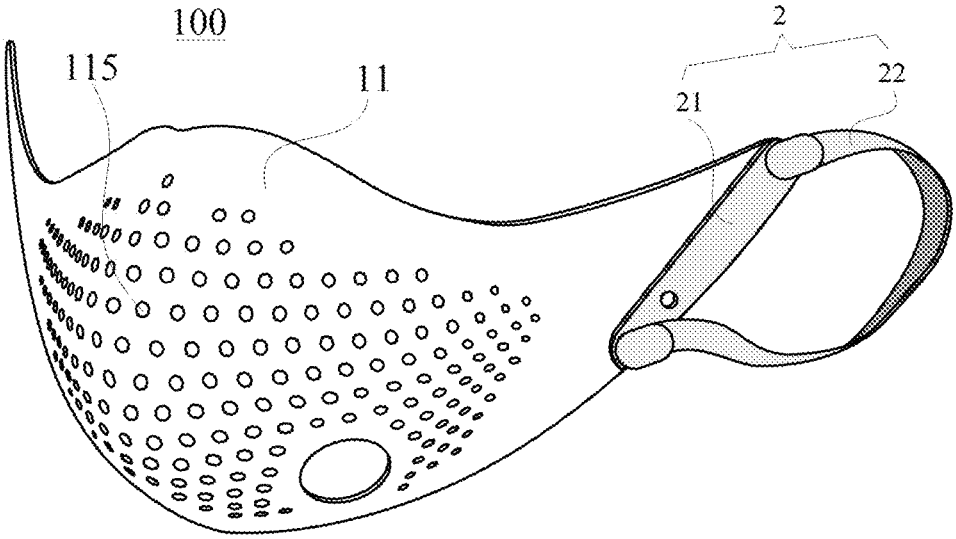
FIG. 1 is a schematic view of a mask according to an embodiment of the present disclosure.

Mask 100;

Outer cover 11; first outer cover portion 111; second outer cover portion 112; third outer cover portion 113; wing 114;

Through hole 115; stop protrusion 116;

Filter 12; transverse hot-melt mark 121; longitudinal hot-melt mark 122; stop hole 123;

Sealing pad 13; supporting sheet body 131; supporting rib 132; first edge 133;

Ear-hanging assembly 2; connecting member 21; ear-hanging strap 22;

First sheet 211; positioning protrusion 2111; second sheet 212; positioning hole 2121.

DETAILED DESCRIPTION

Reference will now be made in detail to exemplary embodiments, examples of which are illustrated in the accompanying drawings. The same or similar elements and the elements having same or similar functions are denoted by like reference numerals throughout the descriptions. The embodiments described herein with reference to the drawings are explanatory, which aim to illustrate the present disclosure, but shall not be construed to limit the present disclosure.

The following description provides many different embodiments or examples to realize different structures of the present disclosure. To simplify the description of the present disclosure, components and configurations in specific examples are elaborated. Of course, they are explanatory, and are not intended to limit the present disclosure. Moreover, reference numbers and/or letters may be repeated in different examples of the present disclosure for the purpose of simplicity and clarity, which shall not be constructed to indicate the relationships among various embodiments and/or configurations. In addition, the present disclosure provides examples of various specific processes and materials, but applicability of other processes and/or utilization of other materials are conceivable for those skilled in the art.

A mask 100 according to embodiments of the present disclosure will be described with reference to FIGS. 1 to 9.

Figure 2:
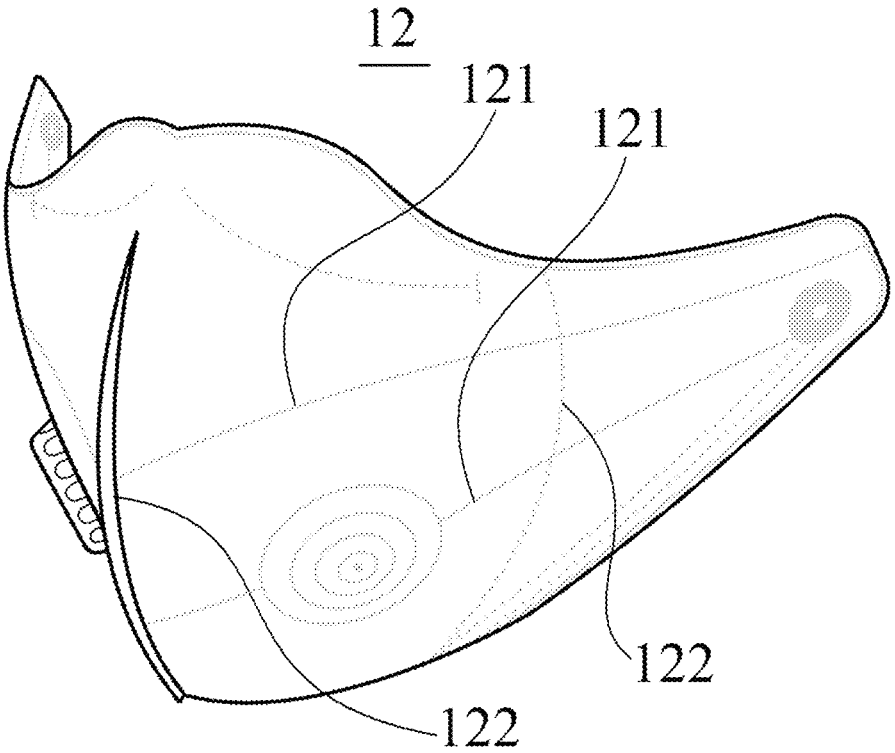
FIG. 2 is a schematic view of a filter shown in FIG. 1.
Figure 5:
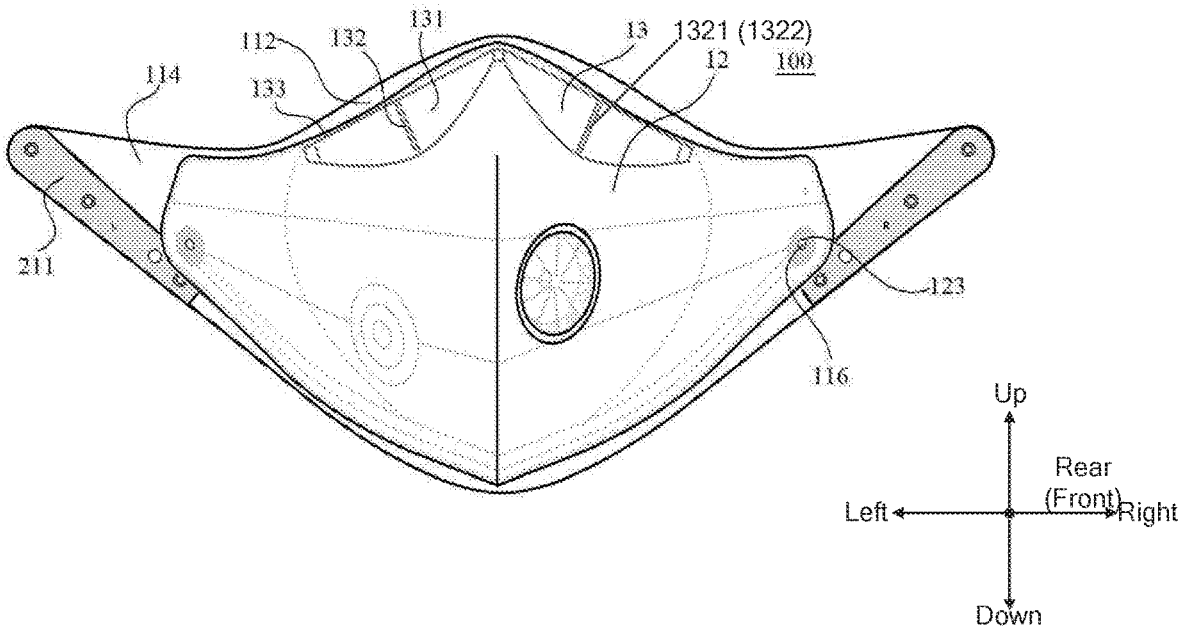
FIG. 5 is a rear view of the mask shown in FIG. 4.

Referring to FIGS. 1-2, in combination with FIG. 5, the mask 100 includes a mask body, and the mask body may include an outer cover 11 and a filter 12, in which the outer cover 11 is disposed at an outer side (i.e. a side away from a user) of the filter 12 to support and protect the filter 12, and the filter 12 is configured to filter air and disposed at an inner side (i.e. a side adjacent to the user) of the outer cover 11. In an embodiment of the present disclosure, the filter 12 and the outer cover 11 may be detachably connected, such that the user may replace the filter 12 or the outer cover 11 for different practical requirements. For example, the user may replace the outer cover with another one having his/her favorite color to show his/her personality, and the user may also replace the filter 12 that has been worn out or used many times, or replace among filters 12 with different filtering effects to adapt to changes of weather conditions.

In a specific embodiment of the present disclosure, referring to FIG. 5, a stop hole 123 is formed in the filter 12, the outer cover 11 is provided with a stop protrusion 116, and the filter 12 and the outer cover 11 are detachably connected by a positioned fit between the position stop hole 123 and the stop protrusion 116. Therefore, the filter 12 only needs to be provided with the stop hole 123, with no need for any other stop protrusion by adhering, welding or other means, so as to reduce processing pollution effectively. That is, the filter 12 will not give off odor or even poison gas released by glue for adhering or welding rods for welding, thus effectively improving safety of wearing the filter 12. Furthermore, the stop hole 123 is easy to process with less processing difficulty and higher processing efficiency. Additionally, the stop protrusion 116 may be processed on a connecting member 21 described below, so as to be indirectly disposed to the outer cover 11.

Referring to FIG. 2, the filter 12 may be made of multiple-layer filtering materials (e.g. a non-woven fabric) and formed by hot-melting. That is, the filter 12 may be configured as a filter body having a three-dimensional shape and molded by hot melting the multiple-layer filtering materials, such that the processed filter 12 has a three-dimensional structure. Thus, the three-dimensional structure of the filter 12 may be designed according to face shapes of most users, i.e. allowing the filter 12 to imitate the user's face shape to the greatest extent, such that edges of the filter 12 may obtain a seamless coverage and a perfect fit over the user's face, thereby improving comfort of wearing the mask 100 and filtering reliability of the filter 12. Meanwhile, a gap is formed between an inner surface of a central portion of the filter 12 and a nose and a mouth of the user, thereby preventing breathing difficulties of the user or discomfort due to exhaled moisture adhered to the face.

Specifically, the filter 12 processed by the above process may maintain a stable three-dimensional structure when it is tiled. When the filter 12 is fixed to a side of the outer cover 11 adjacent to the user, a favorable stereoscopic space may be formed between parts of the filter 12 opposite to the nose and mouth of the user and the user's face, so as to maintain a transverse pressure and a longitudinal tension, such that the filter 12 will not adhere to the face. Additionally, during the hot-melt process, the filter 12 may be provided with a plurality of hot-melt marks distributed along a longitudinal direction (e.g. an up-and-down direction of the user's face) and a transverse direction (e.g. a left-and-right direction of the user's face) of the filter 12, to constitute structural ribs of the filter 12. For example, longitudinal hot-melt marks 122 may be processed at a position on the filter 12 opposite to a nose bridge of the user and at positions on the filter 12 opposite to two sides of the nose bridge, and transverse hot-melt marks 121 may be processed at positions on the filter 12 opposite to upper and lower sides of the mouth of the user, thus enhancing the structural stability of the filter 12 and ensuring that the filter 12 maintains the favorable three-dimensional shape with good transverse pressure and longitudinal tension, so as to keep a certain distance away from the nose and mouth of the user to avoid adhering to the user's face.

Referring to FIG. 1, the outer cover 11 may be configured a hot-pressing molded element of ultra-fine fibers. That is, the outer cover 11 is made of ultra-fine fiber materials (such as polyurethane (PU) and nylon), and manufactured by a hot-pressing molding process. Therefore, the outer cover 11 manufactured by such hot-pressing molding process may have excellent supportability, three-dimensional moldability, flexibility and memorability. It should be understood that the hot-pressing molding process may create a dynamic adaptation property, a stable three-dimensional structure and a micro-tensile fabric property for the same material.

Thus, the outer cover 11 may support the filter 12 reliably due to the good supportability of the outer cover 11, so as to make the filter 12 have a good filtering effect. After the user folds or curls the outer cover 11, the outer cover 11 may be automatically restored to its original three-dimensional shape due to its good memorability when it is unfolded again, such that the outer cover 11 may be used repeatedly and the mask 100 may be easily stored and carried.

Since the outer cover 11 has good three-dimensional moldability and flexibility, the outer cover 11 may be configured based on an ergonomic design idea, such that the outer cover 11 satisfy facial features of most users, so as to apply a minimized and uniform force to the nose, cheeks and chin of the user and thus to allow the entire face of the user to experience the good comfort. Meanwhile, it is ensured that the user's face can contact edges of the outer cover 11 and be sealed therewith when wearing the mask 100, so as to guarantee the filtering effect of the mask 100. Also, it is further ensured to maintain an optimal respiration space between a central portion of the outer cover 11 and the user's face, thereby preventing the filter 12 from adhering to the user's face and thus allowing the user to breathe smoothly and comfortably.

Referring to FIG. 1, the outer cover 11 is formed with a plurality of through holes 115 for ventilation, and hence forms a more effective air passage, thus enhancing air permeability of the mask 100, allowing the user to obtain more air exchanges for the nose and mouth, improving respiration experience of the user, and avoiding an oppressed feeling like wearing an ordinary mask, when the user wears the mask 100. Because the outer cover 11 is made of ultra-fine fibers and formed by hot-pressing, the outer cover 11 has excellent three-dimensional moldability, flexibility, supportability and memorability. Moreover, effective air passages are formed in the outer cover 11 by providing the plurality of through holes 115 in the outer cover 11, so as to reduce respiratory resistance of the mask 100, enhance the air permeability of the mask 100 and improve the respiration experience of the user. Additionally, the filter 12 is provided inside the outer cover 11 of the mask 100, i.e. constituting a double-layer protective structure, so the filter 12 may ensure that the mask 100 has the good filtering effect in the case that the outer cover 11 guarantees the good air permeability of the mask 100.

Referring to FIG. 5, the mask 100 further includes two sealing pads 13, and the two sealing pads 13 are both disposed at an inner side of the filter 12 to be in contact with the user, that is, the two sealing pads 13 each is attached to a side of the filter 12 adjacent to the user so as to contact the user's face. The two sealing pads 13 are located at two sides of the position on the filter 2 opposite to the nose bridge of the user. For example, when a longitudinal central axis of the filter 12 is opposite to the nose bridge of the user, the two sealing pads 13 are disposed at two sides of the longitudinal central axis of the filter 12, such that the two sealing pads 13 are disposed at two sides of the nose bridge of the user, thereby sealing gaps between the filter 12 and the two sides of the nose bridge of the user. It should be noted herein that the term "inner side" throughout the present disclosure refers to the side adjacent to the user rather than being inside or within a certain part. The sealing pad 13 may be configured as a silicone sealing pad 13.

In an embodiment of the present disclosure, referring to FIG. 5, the sealing pad 13 includes a supporting sheet body 131 that is formed as a smooth-curved body projecting in a direction away from the filter 12. That is, the supporting sheet body 131 is substantially formed in a shape of a smooth-curved thin plate and projects towards the user's face, so as to seal the gaps between the filter 12 and the two sides of the nose bridge of the user. Therefore, the sealing pads 13 may be configured to fill the gaps between the filter 12 and the two sides of the nose bridge of the user exactly, so as to ensure that the remaining contour edges of the filter 12 are perfectly fitted with the user's face. Furthermore, because the supporting sheet body 131 is formed in a convex curved shape, comfort for the user's face may be effectively improved when the supporting sheet body 131 contacts the user's face. Additionally, the supporting sheet body 131 has a simple structure, and is easy to process with little material consumption and low cost.

Referring to FIG. 5, the supporting sheet body 131 includes a first edge 133 (e.g. an upper edge of the supporting sheet body 131 shown in the drawings) extending along a straight line, the first edge 133 is connected to the filter 12, and the supporting sheet body 131 may be flipped up and down along the first edge 133. Thus, the supporting sheet body 131 is not fixedly connected with the filter 12, such that the supporting sheet body 131 may be squashed to have a large deformation, thus further broadening the range of people to which the mask 100 is applicable, and further improving the comfort of wearing the mask 100. Additionally, the sealing pad 13 is connected with the filter 12 in a simple manner, so as to improve production efficiency of the mask 100 effectively.

Referring to FIG. 5, the sealing pad 13 further includes a supporting rib 132, and the supporting rib 132 is disposed between the filter 12 and the supporting sheet body 131. Thus, the supporting rib 132 can support the supporting sheet body 131 reliably, ensure that the supporting sheet body 131 projects towards the user's face, and thus improve the sealing reliability of the supporting sheet body 131.

In the embodiment shown in FIG. 5, the supporting rib 132 is connected to the supporting sheet body 131 and configured to swing left and right along a joint of the supporting rib 132 and the supporting sheet body 131. That is, a longitudinal direction of the supporting rib 132 may substantially extend in an up-and-down direction, a thickness direction thereof may substantially extend in a left-and-right direction, and a width direction thereof may substantially extend in a front-and-rear direction, in which the front direction represents a direction facing away from the user's face, and the rear direction represents a direction facing towards the user's face, when the user wears the mask (please also refer to FIG. 7). A rear edge 1321 of the supporting rib 132 may be connected with a front surface of the supporting sheet body 131, and a front edge 1322 of the supporting rib 132 may swing freely.

Therefore, when the gaps between two sides of the nose bridge of a certain user and the filter 12 are small, the supporting sheet body 131 may be squashed forwards to push a rear end of the supporting rib 132 to move forwards, and then the front edge of the supporting rib 132 swings leftwards or rightwards due to restriction from a rear surface of the mask body, so as to reduce the gap between the supporting sheet body 131 and the filter 12, thus avoiding that the mask body is unfavorably bulged forwards, that the supporting rib 132 breaks the filter 12, and that the filter 12 abuts against the user's face through the supporting rib 132. Thus, the sealing pad 13 may be suitable for different users with different face shapes, and hence different users may wear the mask 100 comfortably, which broadens the range of application of the mask 100.

Hence, the sealing pads 13 are provided between the inner side of the filter 12 and the user's face and located at the two sides of the nose bridge, thus improving the sealing performance between the mask 100 and the user's face and avoiding gaps between the filter 12 and the two sides of the nose bridge of the user. Therefore, air that is not filtered by the filter 12 will not enter the mouth and nose of the user through the gaps, thus enhancing the filtering performance of the mask 100 and preventing air exhaled by the user, which may fog the user's glasses and hinder the user from seeing clearly, from being blown towards the user's eyes through the gaps. Additionally, by providing the sealing pads 13 at two sides of the nose bridge, the pressure applied to the nose by the filter 12 is alleviated effectively, which improves the comfort of wearing the mask 100.

Thus, the mask 100 according to the embodiments of the present disclosure may be fully fitted with the user's face, thus ensuring the optimal wearing experience and filtering performance.

Figure 3:
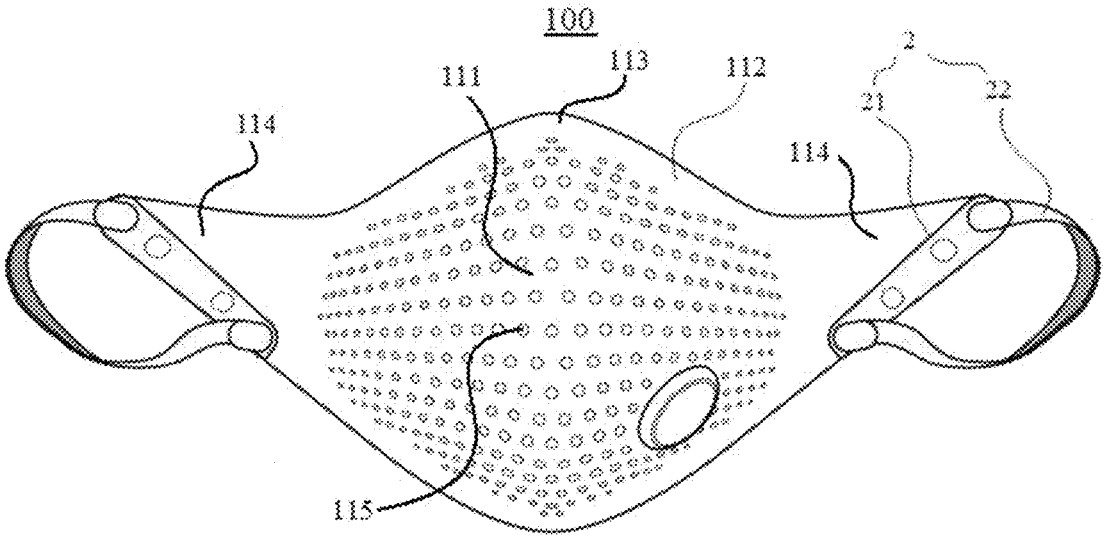
FIG. 3 is a front view of the mask shown in FIG. 1.

Referring to FIG. 1 and FIG. 3, the plurality of through holes 115 are at least facing mouth and nose regions of the user as well as the cheeks of the user, in which a diameter of the through hole 115 facing the mouth and nose regions of the user is larger than that of the through hole 115 facing the cheeks. That is, the diameter of the through hole 115 facing the mouth and nose regions, which have the greatest amount of air inlet and outlet, is relatively large, and the diameter of the through hole 115 facing the cheeks is relatively small. Therefore, a distribution design of the plurality of through holes 115 caters for the user's facial functions, making the distribution design more reasonable, and thus meeting a requirement for the greatest amount of air inlet and outlet in these regions of the outer cover 11. Hence, along a direction from a center of the outer cover 11 to an edge of the outer cover 11, the plurality of through holes 115 are arranged in such a way that the through holes 115 are dispersed gradually in a radial manner, and diameters of the through holes 115 decrease gradually, so as to match the ergonomic design better, which not only guarantees the filtering performance of the mask 100, but also makes the user breathe smoothly.

Figure 7:
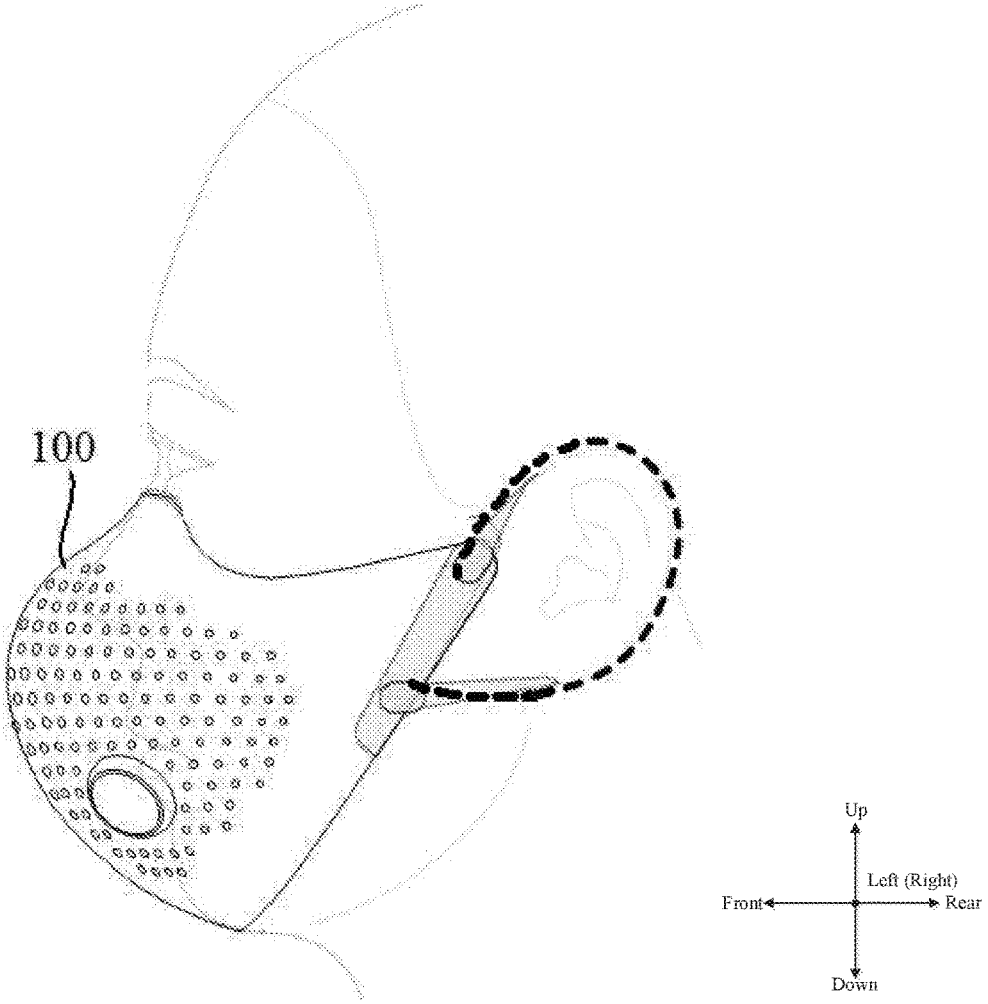
FIG. 7 is a schematic view where a user is wearing a mask according to an embodiment of the present disclosure.
Figure 8:
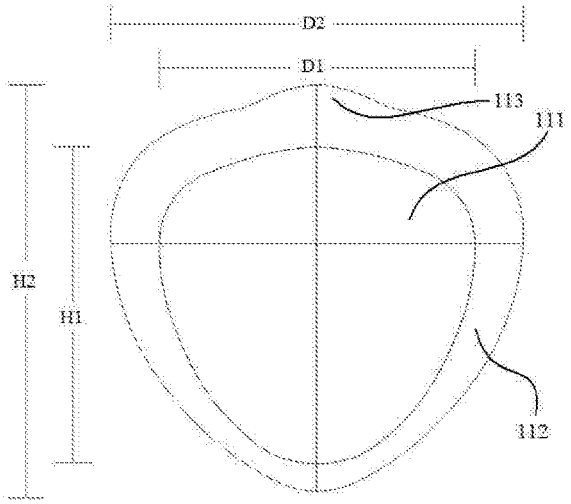
FIG. 8 is a front schematic view of an outer cover according to an embodiment of the present disclosure.

Referring to FIG. 3, FIG. 7 and FIG. 8, the outer cover 11 includes a first outer cover portion 111 and a second outer cover portion 112. The first outer cover portion 111 is opposite to at least the mouth and nose regions of the user and is configured to be spaced apart therefrom. The second outer cover portion 112 surrounds a periphery of the first outer cover portion 111 and is configured to be fitted with the user's skin. In another word, the mask 100 includes the second outer cover portion 112 configured as an annular region and the first outer cover portion 111 connected to an inner ring of the second outer cover portion 112, the first outer cover portion 111 is spaced apart from the mouth and nose regions of the user to form a breathing space, and the second outer cover portion 112 is fitted with facial skins of the user, such as the cheek skin, the nose skin and the chin skin, such that the outer edge of the mask 100 is sealed with the user's face and the unfiltered air is prevented from flowing through the unsealed outer edge into the mask 100 to be inhaled by the user.

Therefore, the most appropriate breathing space can be kept between the mask 100 and the mouth and nose regions of the user by the first outer cover portion 111, so as to guarantee the smooth breathing of the user. The outer edge of the mask 100 can be fitted with the facial skins of the user by the second outer cover portion 112, so as to improve the sealing and the comfort of wearing the mask 100, hence helping the user to wear the mask 100 comfortably and effectively enhancing the filtering efficiency of the mask 100. Meanwhile, the mask 100 is fitted with the user's face by the second outer cover portion 112 having a certain width, hence replacing the solution utilized in the related art that only the edge of the regular mask is fitted with the user's face, such that a contact area of the mask 100 and the user's face is increased, thus alleviating the contact stress and improving the contact comfort. Moreover, the second outer cover portion 112 has the certain width, such that the mask 100 boasts excellent fitting and sealing performances for users with different face shapes, so as to expand the application of the mask 100.

Referring to FIG. 7 and FIG. 8, a middle-lower part of the second outer cover portion 112 narrows gradually from the top to the bottom. That is, the lower edge of the second outer cover portion 112 has a substantial V shape, and hence the second outer cover portion 112 can adapt to the user's facial structure and fit with the cheeks and chin of the user better, thus improving the sealing performance and comfort of wearing the mask 100.

Figure 9:
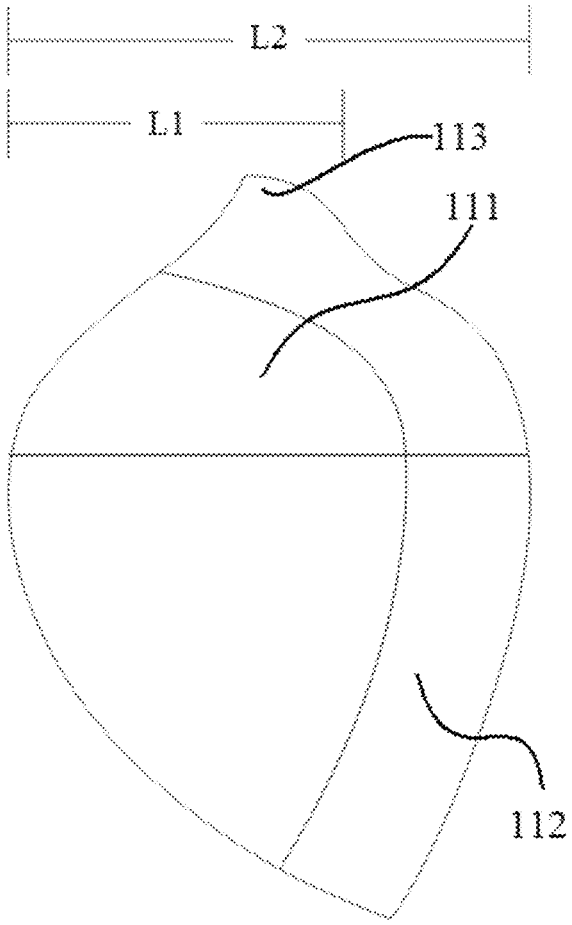
FIG. 9 is a side schematic view of the outer cover shown in FIG. 8.

Referring to FIG. 7 and FIG. 9, the first outer cover portion 111 is bulged forwards in a direction away from the user's head. Therefore, the first outer cover portion 111 can adapt to the user's facial structure better, thus ensuring the first outer cover portion 111 to keep a distance from the mouth and nose regions of the user reliably, and allowing an overall look of the mask 100 to be exquisite and pretty.

Referring to FIG. 7 to FIG. 9, the outer cover 11 further includes a third outer cover portion 113, and the third outer cover portion 113 is connected with the top of the second outer cover portion 112 and is configured to be fitted with the user's nose. Therefore, the mask 100 can adapt to the user's nose structure and fit with the top of the nose bridge better, thus improving the sealing performance and comfort of wearing the mask 100. Referring to FIG. 8, when an upper edge of the third outer cover portion 113 is configured as an arc protruding upwards, the third outer cover portion 113 can fit with the user's nose better and a fitting comfort thereof is improved. Additionally, referring to FIG. 5, the sealing pad 13 may be placed at a position inside the filter 12 right opposite to the third outer cover portion 113 in an inner-and-outer direction, to improve the sealing of the mask 100 and the two sides of the nose bridge.

Figure 4:
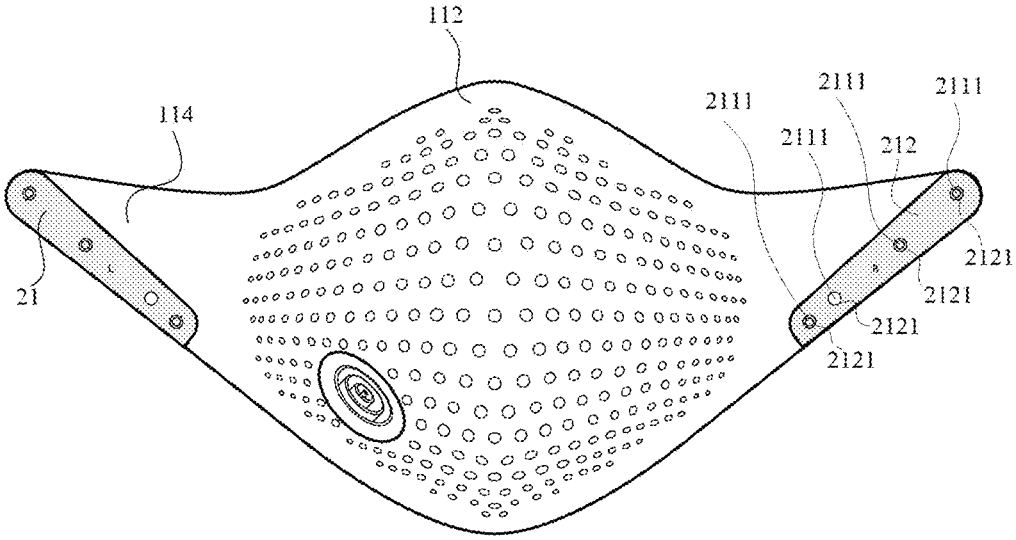
FIG. 4 is a schematic view of the mask shown in FIG. 3, in which an ear-hanging strap is removed.

Referring to FIG. 3 to FIG. 5, the outer cover 11 further includes two wings 114, and the two wings 114 are connected with two sides of the mask body respectively. The mask body includes the first outer cover portion 111, the second outer cover portion 112 and the third outer cover portion 113 mentioned above. The two wings 114 are connected to both sides of the second outer cover portion 112 and extend towards ear gates on both sides of the user respectively. That is, a left side of the second outer cover portion 112 is provided with one wing 114 extending towards a left ear of the user, and a right side thereof is provided with one wing 114 extending towards a right ear of the user.

Therefore, by providing the wings 114 to the second outer cover portion 112, the user can wear the mask 100 more comfortably. Moreover, by providing the two wings 114, the mask 100 can fit with the use's face better, so as to further improve the filtering of the mask 100.

Referring to FIG. 3 to FIG. 5, a distance between an upper edge and a lower edge of the wing 114 decreases gradually in a direction away from the second outer cover portion 112. In another word, a width of the wing 14 in the up-and-down direction decreases gradually from the nose to the ear of the user. Therefore, the design of the wing 114 matches the ergonomic idea better, such that the mask 100 can adapt to and fit with different users' faces having great differences therebetween, thus expanding the range of people to which the mask 100 is applicable. Also, the wing 114 having such a structure can minimize the force applied to the ear of the user, hence reducing the force acted on the ear and improving the comfort of wearing the mask 100. A lower edge of the wing 114 may extend along a straight line, i.e., the wing 114 at the left side of the second outer cover portion 112 obliquely extends upwards and leftwards along a straight line, and the wing 114 at the right side of the second outer cover portion 112 obliquely extends upwards and rightwards along a straight line, such that the wing 114 can fit with the user's face better.

Referring to FIG. 5, an overall lower edge of the outer cover 11 has a substantial V shape, i.e., a lower edge of a left half part of the outer cover 11 obliquely extends upwards and leftwards and a lower edge of a right half part of the outer cover 11 obliquely extends upwards and rightwards, to make the design of the outer cover 11 match with ergonomic factors better, so that when the user wears the mask 100, the forces acted on the chin and cheeks of the user are appropriate and the mask 100 is better fitted with the user's face.

Referring to FIG. 4 and FIG. 5, the first outer cover portion 111, the second outer cover portion 112, the third outer cover portion 113 and the two wings 114 are integrally molded and smoothly transmitted to one another. That is to say, the outer cover 11 is an integrally molded piece and inside and outside surfaces of the outer cover 11 are configured as smooth curved surfaces. The first outer cover portion 111, the second outer cover portion 112, the third outer cover portion 113 and the two wings 114 may be hot-pressed into one integrated piece by using the ultra-fine fiber materials. Hence, the mask 100 has an aesthetic look and strong structural strength. A longitudinal central line of the outer cover 11 is opposite to the nose bridge and the outer cover 11 is axisymmetric with respect to the longitudinal central line thereof. Hence, the outer cover 11 is easy to process, has a strong structural strength, an aesthetic look and adapts to the user's facial structure.

In an embodiment of the present disclosure, as shown in FIG. 5, an outer contour of the filter 12 is similar to an outer contour of the outer cover 11. That is to say, at least a part of the upper edge of the filter 12 has an equal distance from a corresponding part of the upper edge of the outer cover 11, and at least a part of the lower edge of the filter 12 has an equal distance from a corresponding part of the lower edge of the outer cover 11. Or, the whole upper edge of the filter 12 has an equal distance from the whole upper edge of the outer cover 11 and the overall lower edge of the filter 12 has an equal distance from the overall lower edge of the outer cover 11. Thus, under the premise of ensuring the supportability and protectiveness of the outer cover 11, the mask 100 has a more aesthetic look and more materials are saved.

Referring to FIG. 5, the distance between the upper edge of the filter 12 and the upper edge of the outer cover 11 ranges from 1 mm to 3 mm, for example, the distance may be 1 mm, 2 mm, 3 mm and so on. The distance between the lower edge of the filter 12 and the lower edge of the outer cover 11 ranges from 1 mm to 3 mm, for example, the distance may be 1 mm, 2 mm, 3 mm and so on. Thus, under the premise of ensuring the supportability and protectiveness of the outer cover 11, the mask 100 has a more aesthetic look and more materials are saved. The structure of mask 100 is more reasonable, when the distance between the upper edge of the filter 12 and the upper edge of the outer cover 11 and the distance between the lower edge of the filter 12 and the lower edge of the outer cover 11 are both 2 mm.

In an embodiment of the present disclosure, as shown in FIG. 1 and FIG. 3, the mask 100 further includes two ear-hanging assemblies 2, and the two ear-hanging assemblies 2 are detachably connected with two sides of the outer cover 11. For instance, the two ear-hanging assemblies 2 are detachably connected with the two wings 114 respectively. The ear-hanging assembly 2 may include a connecting member 21 and an ear-hanging strap 22. The ear-hanging strap 22 is suitable for hanging on human ears and is connected to the connecting member 21, and the connecting member 21 is detachably connected with the wing 114. Therefore, it is easy to process the ear-hanging assembly 2, meanwhile it is convenient to assemble the ear-hanging assembly 2 with the wing 114, and the user can use the mask 100 conveniently.

Figure 6:
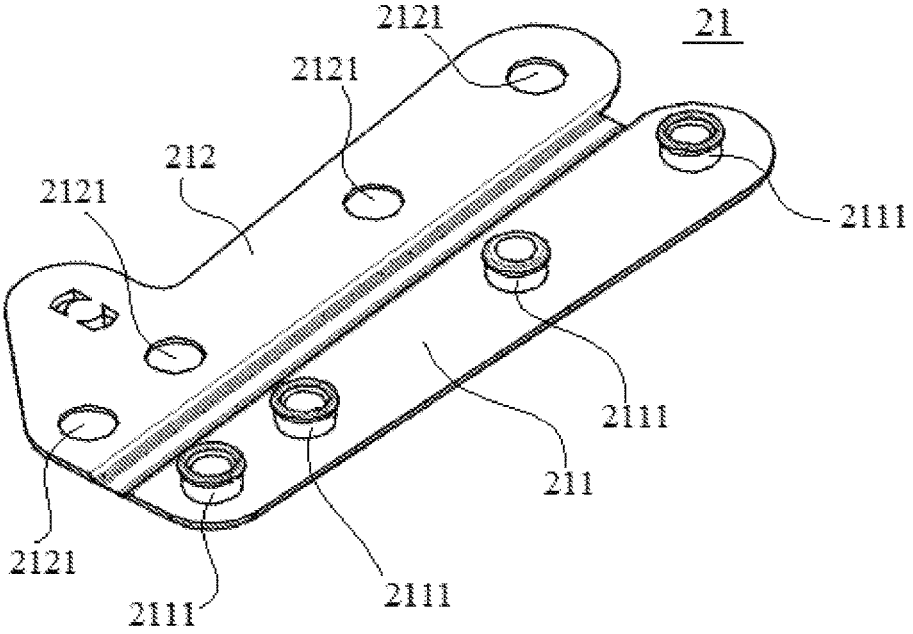
FIG. 6 is a schematic view of a connecting member shown in FIG. 5.

Referring to FIG. 4 and FIG. 6, the connecting member 21 includes a first sheet 211 and a second sheet 212, and the first sheet 211 and the second sheet 212 are connected to each other and foldable with respect to each other along a joint therebetween, and the wing 114 is sandwiched between the first sheet 211 and the second sheet 212, thus effectively improving reliability of connection between the connecting member 21 and the wing 114. For instance, in an embodiment shown in FIG. 6, the first sheet 211 is formed into a rectangular sheet body and the second sheet 212 has the substantially same size and shape as the first sheet 211. A side edge of the first sheet 211 in a width direction thereof is connected with a side edge of the second sheet 212 in a width direction thereof, so as to constitute a connection edge. The first sheet 211 and the second sheet 212 both may be flipped along the connection edge to clamp or loosen the wing 114.

Referring to FIG. 6, the first sheet 211 has a positioning protrusion 2111 and the second sheet 212 has a positioning hole 2121. The positioning protrusion 2111 is positioned and fitted with the positioning hole 2121 after passing through the wing 114. The connecting member 21 can be mounted to and dismounted from the wing 114 flexibly by the positioned fit between the positioning protrusion 2111 and the positioning hole 2121. Additionally, the detachable connection of the connecting member 21 and the wing 114 is realized only by the structure of the connecting member 21 itself. Thus, on one hand, the wing 114 just needs to be perforated without processing complex connecting structures thereon, thereby reducing the difficulty of producing the wing 114. On the other hand, since it is not necessary to connect the connecting member 21 with the wing 114 by means of gluing or suchlike, it is possible to avoid undesirable gas generated in the gluing process from affecting the user's health.

Referring to FIG. 6, a plurality of the positioning protrusions 2111 are provided and spaced apart from one another in a longitudinal direction of the first sheet 211. A plurality of the positioning holes 2121 are provided and spaced apart from one another in a longitudinal direction of the second sheet 212. The plurality of positioning holes 2121 are in one-to-one correspondence with the plurality of positioning protrusions 2111. That is, the first sheet 211 is provided with multiple positioning protrusions 2111, the second sheet 212 is provided with multiple positioning holes 2121, and locations of the multiple positioning holes 2121 are in one-to-one correspondence with locations of the multiple positioning protrusions 2111, so that the multiple positioning protrusions 2111 can be connected with the multiple positioning holes 2121 while being fitted therewith. Therefore, through connecting the first sheet 211 with the second sheet 212 by the multiple positioning protrusions 2111 and the multiple positioning holes 2121, it is possible to effectively improve the connection reliability between the connecting member 21 and the wing 114.

Referring to FIG. 3, the ear-hanging strap 22 has a non-closed ring shape and both ends of the ear-hanging strap 22 are respectively connected to the connecting member 21, so as to define an ear-hanging ring between the ear-hanging strap 22 and the connecting member 21, such that it is possible to adjust a circumference of the ear-hanging ring by adjusting a connection position of the ear-hanging strap 22 and the connecting member 21 and by adjusting an extension and contraction length of the ear-hanging strap 22. Additionally, when the ear-hanging strap 22 is detachably connected to the connecting member 21, at least two or more pairs of ear-hanging straps 22 of different lengths may be attached at the time of selling the mask 100, so that the user can select either longer or shorter ear-hanging strap 22 to be mounted to the wing 114 according to his/her own situations, thus further expanding the range of people to which the mask 100 is applicable.

In an embodiment of this disclosure, one of the ear-hanging strap 22 and the connecting member 21 is provided with a plurality of first positioning pieces, while the other one thereof is provided with a second positioning piece positioned and fitted with any one of the plurality of first positioning pieces, such that it is possible to easily and quickly assemble and disassemble the ear-hanging strap 22 and the connecting member 21 as well as to easily adjust the circumference of the ear-hanging ring.

Referring to FIG. 3 and FIG. 7, the first positioning piece is pivotably positioned and fitted with the second positioning piece. The ear-hanging strap 22 can realize a multi-angle rotation on the connecting member 21, so that an included angle between the ear-hanging strap 22 and the connecting member 21 can be adjusted. Hence, by adjusting a rotation angle of the ear-hanging strap 22 with respect to the connecting member 21, an appropriate manner in which the force is applied to the ear can be selected by the user, thus further enhancing the comfort of wearing the mask 100 and allowing the mask 100 to adapt to users with a variety of facial shapes and ear shapes.

As described above, according to the mask 100 of embodiments of the present disclosure, since the outer cover 11 is produced by the special hot-press molding process, the dynamic adaptation property is provided on the same material, i.e., the outer cover 11 has the stable three-dimensional structure and the micro-tensile fabric property, such that the outer cover 11 presents the three-dimensional structure upon being opened and can be folded or rolled up, and when the outer cover 11 is opened again, the outer cover 11 returns to the original three-dimensional shape. The filter 12 is capable of maintaining a stable three-dimensional structure while being tiled, and after the filter 12 is mounted to the side of the outer cover 11 adjacent to the user, the filter 12 is capable of establishing a good stereoscopic breathing space with the user's face. Because the filter 12 has the transverse hot-melt mark 121 and/or the longitudinal hot-melt mark 122, the filter 12 can maintain the good lateral pressure and longitudinal tension, so as to ensure a certain distance from the user's face. Moreover, the hot-melt marks are distributed in the most important functional regions of the filter 12, for examples regions opposite to the mouth and nose regions of the user, thereby further preventing the filter from sticking onto the user's face. Furthermore, when the central axis of the filter 12 is opposed to the nose bridge of the user and the filter 12 is foldable along the central axis, the filter 12 is more easily fitted with an inner layer of the outer cover 11 while helping the sealing pad 13 to achieve an optimal mounting angle thereof.

In the specification, relative terms such as "up", "down", "front", "rear", "left" and "right" should be construed to refer to "up", "down", "front", "rear", "left" orientations relative to the user's face when the user is wearing the mask 100.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

Reference throughout this specification to "an embodiment", "some embodiments", "an example", "a specific example" or "some examples" means that a particular feature, structure, material, or characteristic described in connection with the embodiment or example is included in at least one embodiment or example of the present disclosure. Thus, the appearances of the phrases such as "in some embodiments", "in one embodiment", "in an embodiment", "in another example", "in an example", "in a specific example" or "in some examples" in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure. The scope of the present disclosure is defined by the claims or the like.

What is claimed is:

1. A mask, comprising:

an outer cover made of ultra fine fibers and formed by hot-pressing, the outer cover having a plurality of through holes for ventilation and having a predetermined three-dimensional shape to fit facial features of a user;

a filter configured to filter air and disposed at a side of the outer cover adjacent to the user; and two sealing pads, each attached to a side of the filter adjacent to the user and configured to contact skins at two sides of a nose bridge of the user to seal gaps between the filter and the two sides of the nose bridge of the user, wherein each sealing pad comprises:

a supporting sheet body formed as a smooth-curved body projecting in a direction away from the filter; and a supporting rib sandwiched between the filter and the supporting sheet body, and arranged substantially in middle of the supporting sheet body along a left and right direction, for supporting the supporting sheet body, wherein the supporting sheet body comprises a first edge extending along a straight line and connected to the filter, and the supporting sheet body is configured to be flipped up and down along the first edge;

the supporting rib comprises a front edge and a rear edge connected with a front surface of the supporting sheet body, the front edge being configured to swing leftwards or rightwards around a joint of the rear edge of the supporting rib and the front surface of the supporting sheet body to reduce a gap between the supporting sheet body and the filter due to restriction from a rear surface of the filter when the supporting sheet body is pressed forwards to push the supporting rib to move forwards; and the first edge of the supporting sheet body extends n a direction substantially perpendicular to an extending direction of the rear edge of the supporting rib.

2. The mask according to claim 1, wherein a first number of the plurality of through holes are opposed to mouth and nose regions of the user, and a second number of the plurality of through holes are opposed to a cheek of the user, wherein a diameter of each of the first number of the plurality of through holes opposite to the mouth and nose regions of the user is larger than a diameter of each of the second number of the plurality of through holes opposite to the cheek of the user.

3. The mask according to claim 1, wherein the outer cover comprises:

a first outer cover portion, opposite to at least the mouth and nose regions of the user and configured to be spaced apart from the mouth and nose regions of the user; and a second outer cover portion, surrounding a periphery of the first outer cover and configured to fit with the skin of the user.

4. The mask according to claim 3, wherein the outer cover further comprises:

a third outer cover portion, connected to a top of the second outer cover portion and configured to fit with a nose of the user, wherein an upper edge of the third outer cover portion is formed in an upwardly convex arc shape.

5. The mask according to claim 3, wherein the outer cover comprises two wings, and the two wings are connected to both sides of the second outer cover portion and extend towards ear gates on both sides of the user, respectively.

6. The mask according to claim 5, wherein a distance between an upper edge and a lower edge of each wing is decreased gradually towards the ear gate at a corresponding side.

7. The mask according to claim 5, further comprising:

two ear-hanging assemblies detachably connected with two sides of the outer cover, respectively.

8. The mask according to claim 7, wherein each ear-hanging assembly comprises:

a connecting member detachably connected with the outer cover; and an ear-hanging strap connected to the connecting member and configured to hang on the ear of the user.

9. The mask according to claim 8, wherein the connecting member comprises:

a first sheet having a positioning protrusion; and a second sheet having a positioning hole operable with the positioning protrusion that passes through the outer cover, wherein the first sheet and the second sheet are connected with each other and foldable with respect to each other along a joint therebetween, and the wing is sandwiched between the first sheet and the second sheet.

10. The mask according to claim 8, wherein both ends in a longitudinal direction of the ear-hanging strap are detachably connected with the connecting member.

11. The mask according to claim 8, wherein both ends in a longitudinal direction of the ear-hanging strap are pivotably connected with the connecting member.

12. The mask according to claim 1, wherein an overall lower edge of the outer cover is formed in a substantial V shape.

13. The mask according to claim 1, wherein an outer contour of the filter is similar to an outer contour of the outer cover.

14. The mask according to claim 13, wherein a distance between an upper edge of the filter and an upper edge of the outer cover ranges from 1 mm to 3 mm, and a distance between a lower edge of the filter and a lower edge of the outer cover ranges from 1 mm to 3 mm.

15. The mask according to claim 1, wherein the filter is made of multiple-layer filtering materials and formed by hot-melting, and has hot-melt marks opposite to mouth and nose regions of the user.

16. The mask according to claim 15, wherein the hot-melt marks comprise a transverse hot-melt mark extending in a left-and-right direction, and/or a longitudinal hot-melt mark extending in an up-and-down direction.

17. The mask according to claim 1, wherein the filter and the outer cover are detachably connected.

18. The mask according to claim 17, wherein the filter has a stop hole and the outer cover has a stop protrusion operable with the stop hole to detachably connect with the filter.

* * * * *